US011320135B1

(12) United States Patent
Wang

(10) Patent No.: US 11,320,135 B1
(45) Date of Patent: May 3, 2022

(54) LAMP ASSEMBLY FOR CEILING FAN

(71) Applicant: AIR COOL INDUSTRIAL CO., LTD., Taichung (TW)

(72) Inventor: Cliff Wang, Taichung (TW)

(73) Assignee: AIR COOL INDUSTRIAL CO., LTD., Taichung (TW)

( * ) Notice: Subject to any disclaimer, the term of this patent is extended or adjusted under 35 U.S.C. 154(b) by 0 days.

(21) Appl. No.: 17/349,242

(22) Filed: Jun. 16, 2021

(51) Int. Cl.

| | |
|---|---|
| ***F21V 33/00*** | (2006.01) |
| ***F21V 29/76*** | (2015.01) |
| ***F21V 29/60*** | (2015.01) |
| *F21Y 115/10* | (2016.01) |

(52) U.S. Cl.
CPC ..... *F21V 29/763* (2015.01); *F21V 29/60* (2015.01); *F21V 33/0096* (2013.01); *F21Y 2115/10* (2016.08)

(58) Field of Classification Search
CPC ..... F21V 29/763; F21V 29/60; F21V 33/0096
See application file for complete search history.

(56) References Cited

U.S. PATENT DOCUMENTS

2004/0001344 A1* 1/2004 Hecht ..... F21V 29/763 362/555
2006/0193139 A1* 8/2006 Sun ..... F21V 29/60 362/373
2011/0227469 A1* 9/2011 Yuan ..... F21V 3/12 313/46

* cited by examiner

*Primary Examiner* — Y M. Quach Lee
(74) *Attorney, Agent, or Firm* — Pai Patent & Trademark Law Firm; Chao-Chang David Pai

(57) ABSTRACT

A lamp assembly installed to a ceiling fan includes a heat dissipation module and a lamp. The heat dissipation module has a heat dissipation body. The heat dissipation body is mounted to a connecting seat of the ceiling fan. The heat dissipation body includes a plurality of heat dissipation units on one side of the heat dissipation body adjacent to the connecting seat. The heat dissipation units have an axis. The heat dissipation units are sequentially arranged from inside to outside relative to the axis. The heat dissipation units each have at least one heat dissipation fin relative to the axis. The lamp is fixedly connected to another side of the heat dissipation body. The lamp assembly has a better heat dissipation effect and can be installed quickly.

8 Claims, 7 Drawing Sheets

LAMP ASSEMBLY FOR CEILING FAN

FIELD OF THE INVENTION

The present invention relates to a lamp assembly, and more particularly to a lamp assembly for a ceiling fan.

BACKGROUND OF THE INVENTION

In the current technical field of ceiling fans, a lamp is generally installed beneath a ceiling fan. The lamp has a light-emitting member therein. In general, the light-emitting member of the lamp is a spiral energy-saving bulb. With the setting of the lamp, the ceiling fan has the functions of ventilation, cooling and illumination.

However, with the rapid advancement of light-emitting diode (LED) technology, LED lamps are more energy-saving and lighter than traditional lamps, so LED lamps are widely used on the market. Due to the poor heat dissipation of the light-emitting diode (LED), the light-emitting diode (LED) is prone to overheating and burning out. Accordingly, the inventor of the present invention has devoted himself based on his many years of practical experiences to solve these problems.

SUMMARY OF THE INVENTION

The primary object of the present invention is to provide a lamp assembly for a ceiling fan, which has a better heat dissipation effect and can be installed quickly.

In order to achieve the above object, the present invention provides a lamp assembly installed to a ceiling fan. The ceiling fan has a connecting seat. The lamp assembly comprises a heat dissipation module and a lamp. The heat dissipation module has a heat dissipation body. The heat dissipation body is mounted to the connecting seat. The heat dissipation body includes a plurality of heat dissipation units on one side of the heat dissipation body adjacent to the connecting seat. The heat dissipation units have an axis. The heat dissipation units are sequentially arranged from inside to outside relative to the axis. The heat dissipation units each have at least one heat dissipation fin relative to the axis. The lamp is fixedly connected to another side of the heat dissipation body.

When in use, the thermal energy of the lamp is transferred to the heat dissipation fins of the heat dissipation units of the heat dissipation body to be dissipated through air flow generated by the ceiling fan. The lamp assembly has a better heat dissipation effect and can be installed quickly.

DETAILED DESCRIPTION OF THE PREFERRED EMBODIMENTS

Embodiments of the present invention will now be described, by way of example only, with reference to the accompanying drawings.

Figure 1:
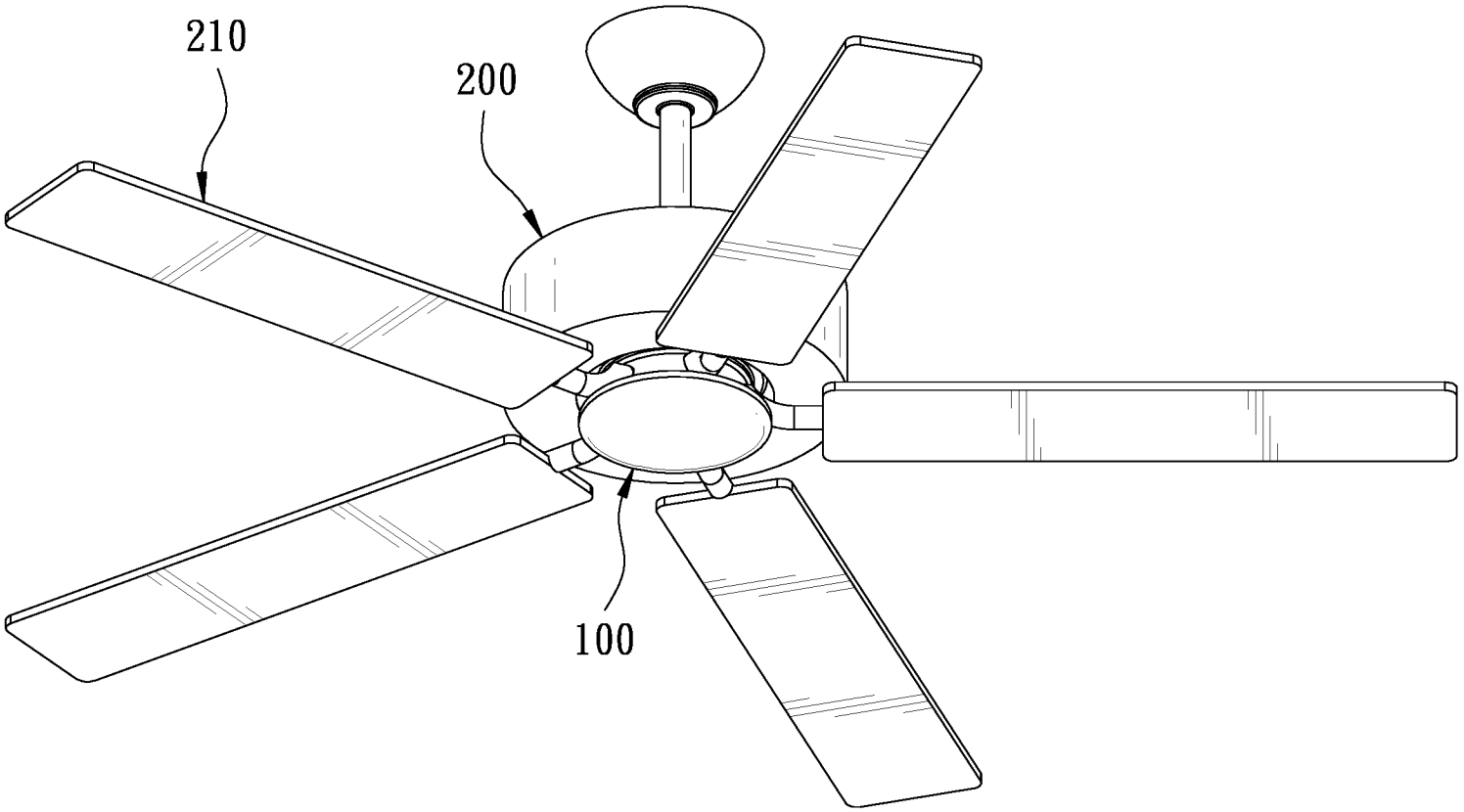
FIG. 1 is a perspective view in accordance with a preferred embodiment of the present invention.
Figure 2:
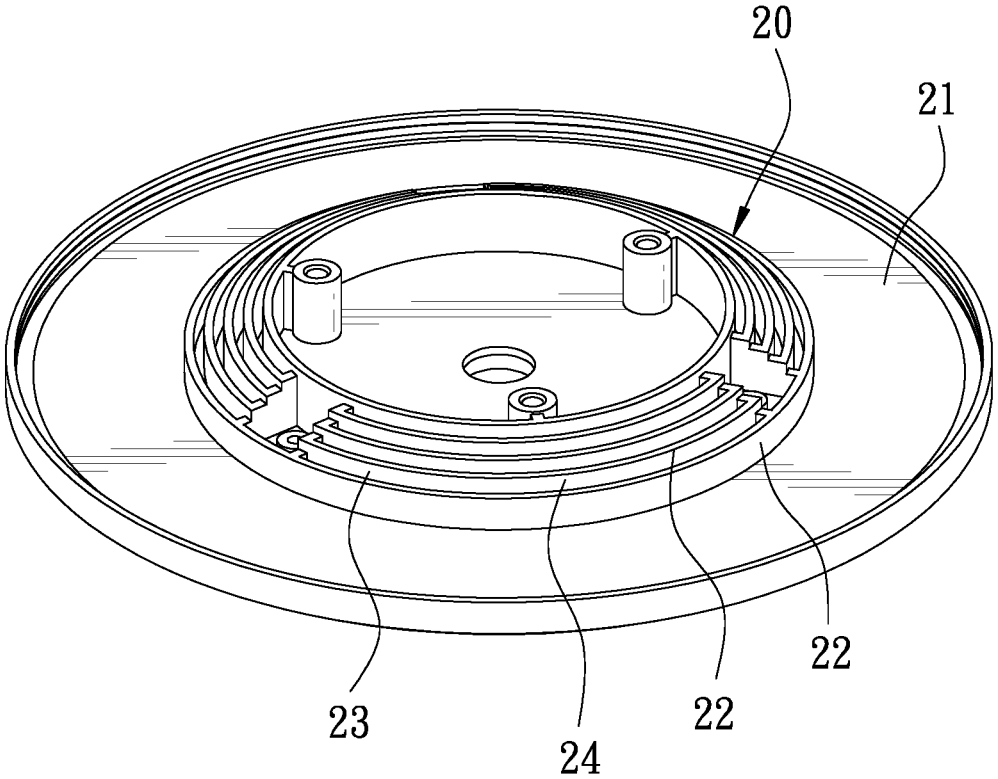
FIG. 2 is a partial perspective view in accordance with the preferred embodiment of the present invention.
Figure 3:
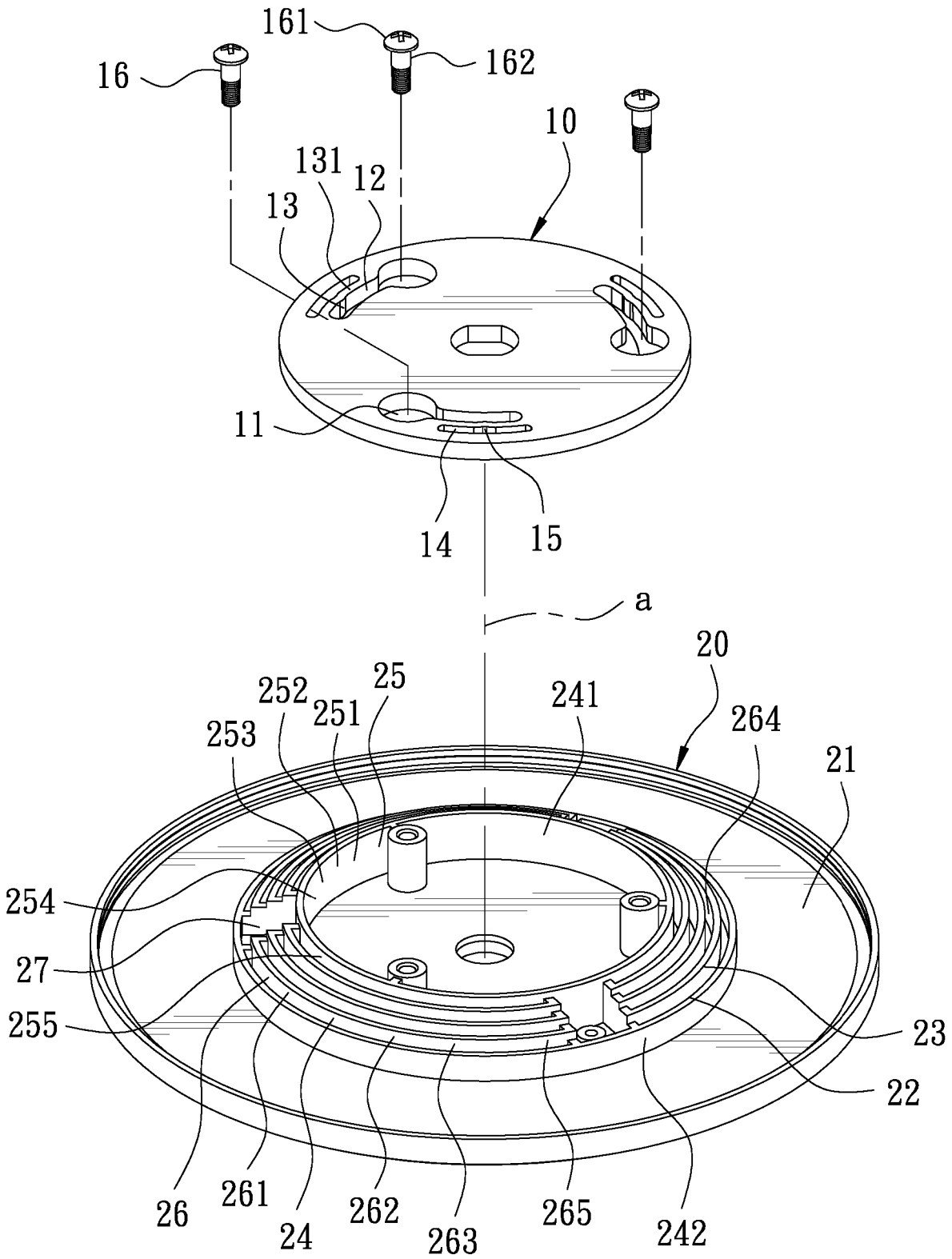
FIG. 3 is a partial exploded view in accordance with the preferred embodiment of the present invention.

FIG. 1 is a perspective view in accordance with a preferred embodiment of the present invention. FIG. 2 is a partial perspective view in accordance with the preferred embodiment of the present invention. FIG. 3 is a partial exploded view in accordance with the preferred embodiment of the present invention. The present invention discloses a lamp assembly 100 for a ceiling fan. The lamp assembly 100 is installed to a ceiling fan 200. The ceiling fan 200 includes a plurality of blades 210. The ceiling fan 200 has a connecting seat 10. The lamp assembly 100 includes a heat dissipation module 20 and a lamp 30.

The connecting seat 10 is formed with a plurality of through positioning holes 11 each having a guide hole 12 extending from its one side along a rotation direction. The inner wall of a long side of the guide hole 12 is transversely provided with a protrusion 13. The connecting seat 10 further has elastic portions 131 each corresponding to the protrusion 13. The protrusion 13 is arranged on the wall of the corresponding elastic portion 131, so that the protrusion 13 has slight elasticity. The connecting seat 10 is formed with elongated holes 14 each close to one side of the protrusion 13 of the guide hole 12, so that each elastic portion 131 is formed between the guide hole 12 and the elongated hole 14. The elongated hole 14 has a recess 15 corresponding to the protrusion 13. The connecting seat 10 further includes a plurality of fasteners 16. One end of each fastener 16 is fixedly connected to at least one of the heat dissipation module 20 and the lamp 30. The other end of each fastener 16 has a head portion 161 corresponding in position and diameter to the positioning hole 11. Each fastener 16 further has a body portion 162 extending from the head portion 161 and corresponding in position and diameter to the guide hole 12. The diameter of the head portion 161 is greater than the diameter of the body portion 162. The head portions 161 of the fasteners 16 are inserted in the positioning holes 11, and the body portions 162 of the fasteners 16 enter the guide holes 12 by pushing the protrusions 13, respectively. The body portions 162 of the fasteners 16 are positioned in the guide holes 12 of the connecting seat 10 through the protrusions 13, respectively.

Figure 4:
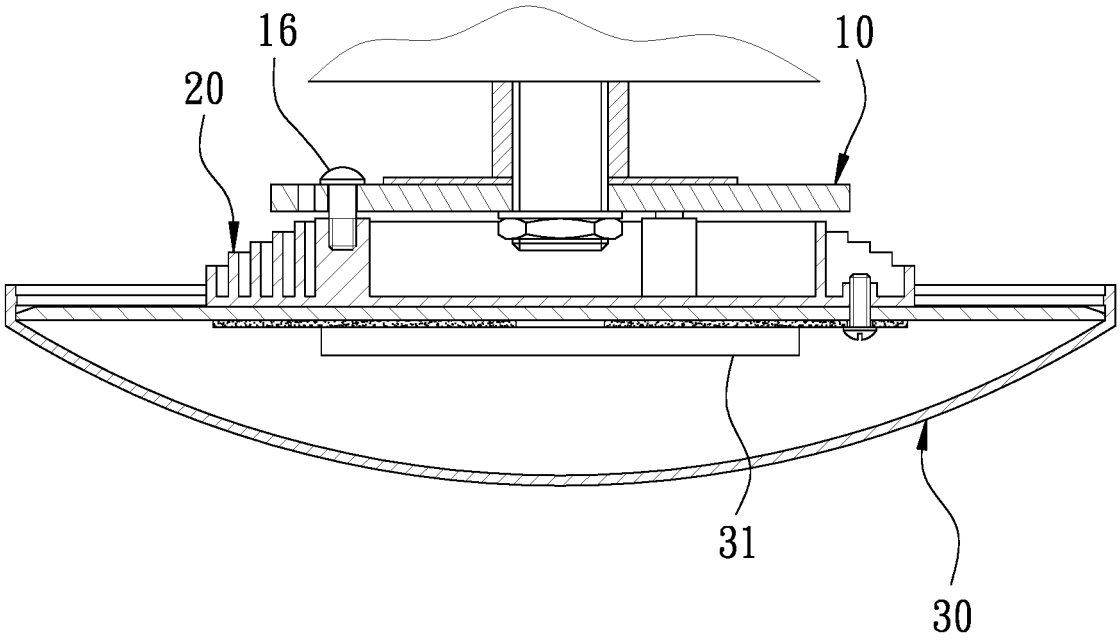
FIG. 4 is a cross-sectional view in accordance with the preferred embodiment of the present invention.

FIG. 4 is a cross-sectional view in accordance with the preferred embodiment of the present invention. The heat dissipation module 20 is located close to the inner sides of the blades 210 of the ceiling fan 200. The heat dissipation module 20 has a heat dissipation body 21. The heat dissipation body 21 is mounted to the connecting seat 10. The heat dissipation body 21 includes a plurality of heat dissipation units 22 on one side of the heat dissipation body 21 adjacent to the connecting seat 10. The heat dissipation units 22 have an axis a. The heat dissipation units 22 are sequentially arranged from inside to outside relative to the axis a. The heat dissipation units 22 each have at least one heat dissipation fin 23 relative to the axis a. The heat dissipation fins 23 of the heat dissipation units 22 extend outwardly from the heat dissipation body 21. The heat dissipation fins 23 are spaced apart from the connecting seat 10. The respective heights of the heat dissipation fins 23 of the heat dissipation units 22 gradually decrease from inside to outside. The heat dissipation fins 23 of the heat dissipation units 22 each have a heat dissipation portion 24. The heat dissipation portions 24 of every adjacent two of the heat dissipation units 22 are spaced a determined distance apart from each other. The heat dissipation portions 24 of each heat dissipation unit 22 are arranged concentrically around the axis with an equal radius, so that the heat dissipation units 22 each have a ring shape or a ring-like shape. The heat dissipation units 22 are arranged in a multilayer configuration. The heat dissipation portion 24 has an inner surface 241 facing the axis a and an outer surface 242 facing away from the axis a. The inner surface 241 and the outer surface 242 of the heat dissipation portion 24 are curved surfaces. The surface areas of the inner surface 241 and the outer surface 242 of the heat dissipation portion 24 are the top two of all surface areas of the heat dissipation portion 24. The heat dissipation units 22 are classified into a first group 25 and a second group 26. The heat dissipation units 22 of the first group 25 each have a single heat dissipation fin 23. The heat dissipation portion 253 of the heat dissipation fin 252 of the heat dissipation unit 251 of the first group 25 is annular. The inner surface 254 and the outer surface 255 of the heat dissipation portion 253 of the heat dissipation unit 251 of the first group 25 are annular surfaces. The heat dissipation units 22 of the second group 26 each have at least two heat dissipation fins 23. The heat dissipation portion 263 of the heat dissipation fin 262 of the heat dissipation unit 261 of the second group 26 has an arc shape. The inner surface 264 and the outer surface 265 of the heat dissipation portion 263 of the heat dissipation unit 261 of the second group 26 are curved surfaces. The arc length of each of the inner surface 264 and the outer surface 265 of each heat dissipation portion 263 of the second group 26 is greater than the thickness of each heat dissipation portion 263 of the second group 26. The heat dissipation portions 263 of the heat dissipation fins 262 of each heat dissipation unit 261 of the second group 26 are arranged concentrically around the axis with an equal radius. The heat dissipation units 22 of the second group 26 each have a ring shape. In addition, the heat dissipation portions 24 of the heat dissipation fins 23 of the heat dissipation units 22 are connected by at least one connecting portion 27. The connecting portion 27 has a stepped cross-section.

The heat dissipation surface of the lamp 30 is fixedly attached to the other side of the heat dissipation body 21 for heat transfer. The lamp 30 has at least one light-emitting member 31. The light-emitting member 31 is an LED lamp.

Figure 5:
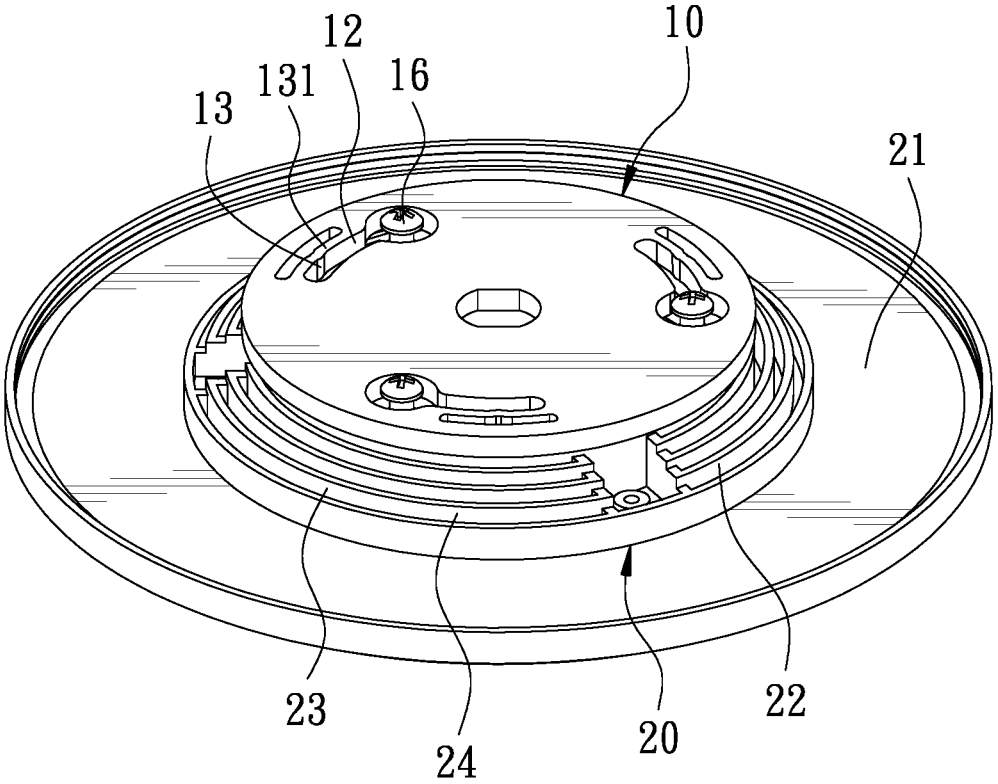
FIG. 5 is a schematic view of the operation of the preferred embodiment of the present invention.
Figure 6:
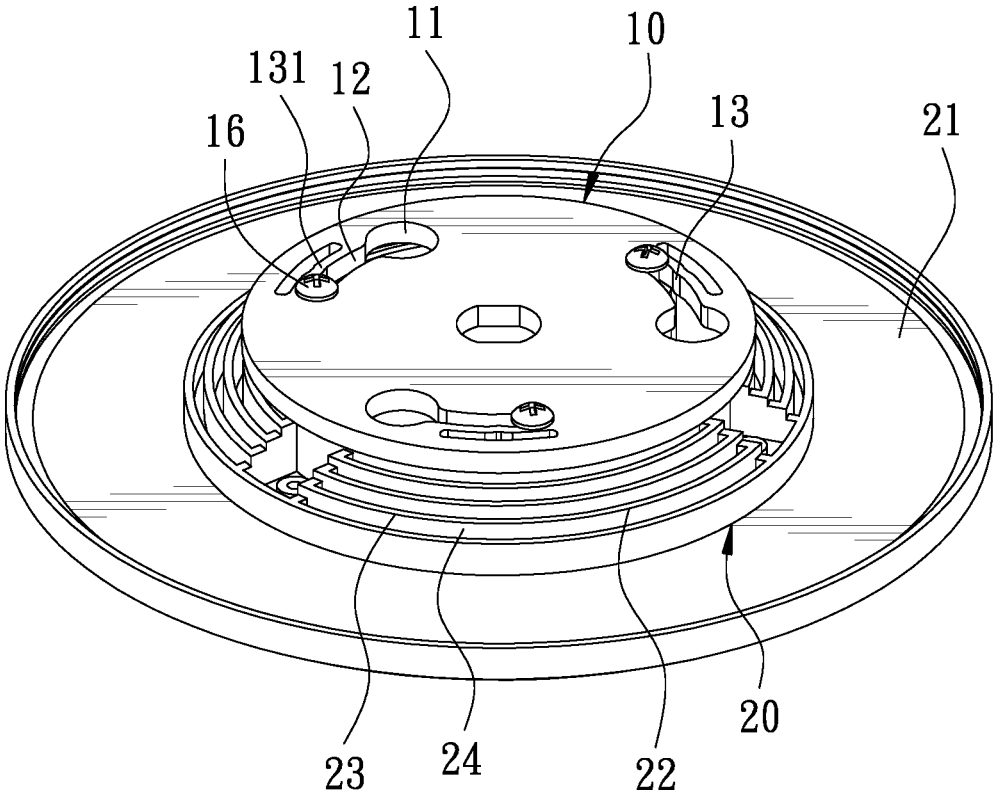
FIG. 6 is another schematic view of the operation of the preferred embodiment of the present invention.

FIG. 5 and FIG. 6 are schematic views of the operation of the preferred embodiment of the present invention. When the lamp assembly 100 is to be installed, the fasteners 16 are first aligned with the positioning holes 11 of the connecting seat 10, respectively. Then, the head portions 161 of the fasteners 16 are inserted in the positioning holes 11, respectively. With the elasticity of the elastic members 131, the body portions 162 of the fasteners 16 quickly enter the guide holes 12 by pressing the protrusions 13, respectively. Through the protrusions 13, the fasteners 16 are locked in the guide holes 12 of the connecting seat 10 to prevent the fasteners 16 from falling off due to vibration, so as to complete the installation of the lamp assembly 100 in a quick manner.

Figure 7:
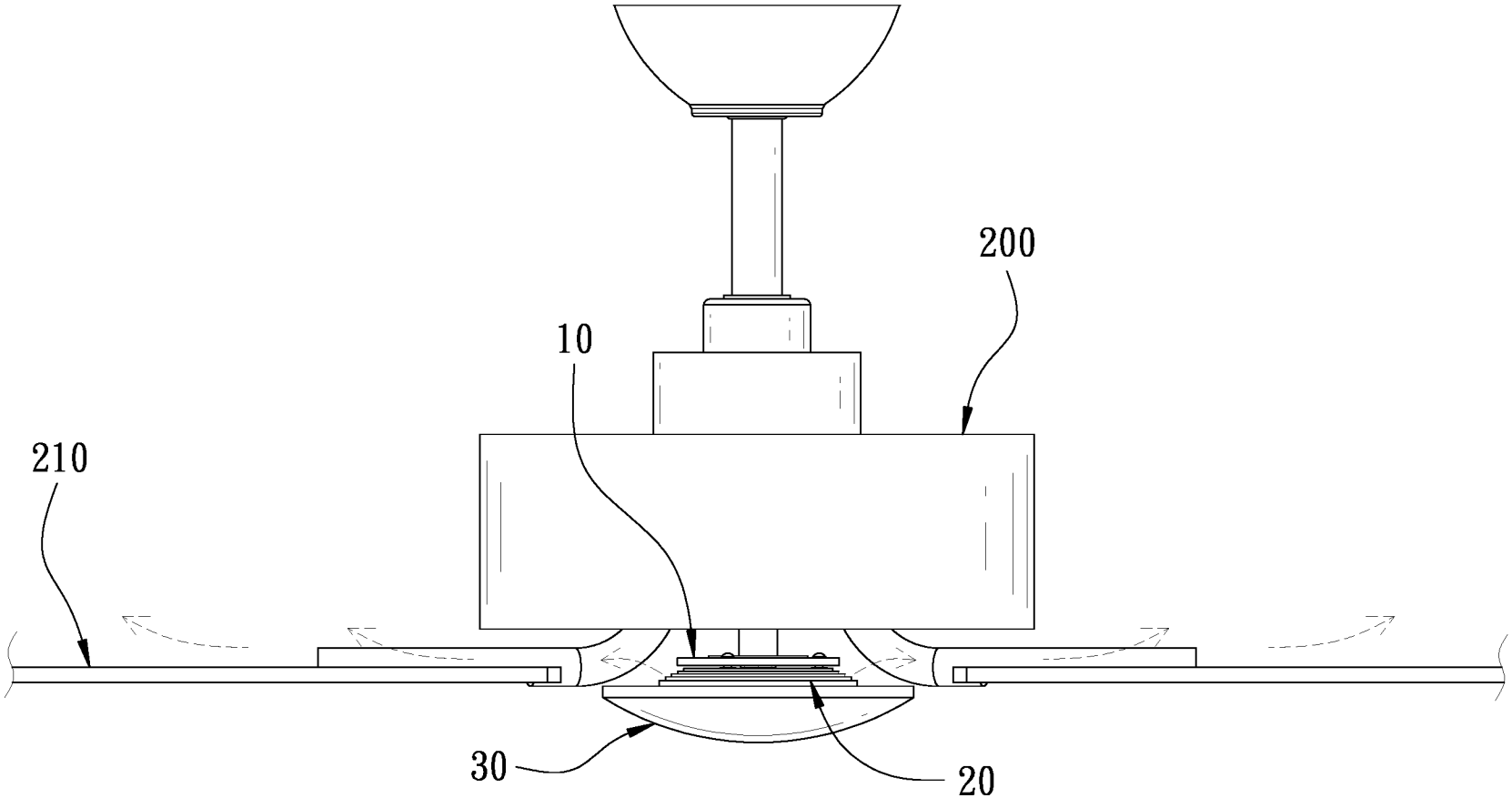
FIG. 7 is a schematic view of the preferred embodiment of the present invention when in use.

FIG. 7 is a schematic view of the preferred embodiment of the present invention when in use. Because the light-emitting member 31 of the lamp 30 is an LED lamp, the temperature of the light-emitting member 31 is likely to be too high if it is used for a long time. The lamp 30 is fixed to the heat dissipation body 21, so that the thermal energy of the lamp 30 is easily transferred to the heat dissipation fins 23 of the heat dissipation body 21. A gap is formed between the connecting seat 10 and the heat dissipation fins 23 of the heat dissipation module 20. Because the heights of the heat dissipation fins 23 gradually decrease from inside to outside, the heat emitted by the light-emitting member 31 can flow out via the gap through the radiating fins 23. The rotation of the blades 210 generates air flow, which allows the hot air to be discharged smoothly, thereby achieving the effect of heat dissipation.

It is worth mentioning that the heat dissipation portion 253 of the heat dissipation fin 252 of the heat dissipation unit 251 of the first group 25 is annular. The inner surface 254 and the outer surface 255 of the heat dissipation portion 253 of the heat dissipation unit 251 of the first group 25 are annular surfaces. The heat dissipation portion 263 of the heat dissipation fin 262 of the heat dissipation unit 261 of the second group 26 has an arc shape. The inner surface 264 and the outer surface 265 of the heat dissipation portion 263 of the heat dissipation unit 261 of the second group 26 are curved surfaces. The heat dissipation portions 263 of the heat dissipation fins 262 of each heat dissipation unit 261 of the second group 26 are arranged concentrically around the axis a with an equal radius. The heat dissipation units 22 of the second group 26 each have a ring shape. Thereby, through the shape design of the heat dissipation unit 22 of the heat dissipation module 20, the lamp assembly 100 has a better heat dissipation effect.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A lamp assembly, installed to a ceiling fan having a connecting seat, comprising:

a heat dissipation module, having a heat dissipation body, the heat dissipation body being mounted to the connecting seat, the heat dissipation body including a plurality of heat dissipation units on one side of the heat dissipation body adjacent to the connecting seat, the heat dissipation units having an axis, the heat dissipation units being sequentially arranged from inside to outside relative to the axis, the heat dissipation units each having at least one heat dissipation fin relative to the axis; and a lamp, fixedly connected to another side of the heat dissipation body;

wherein the heat dissipation fins of the heat dissipation units extend outwardly from the heat dissipation body, the heat dissipation fins of the heat dissipation units each have a heat dissipation portion, the heat dissipation portions of every adjacent two of the heat dissipation units are spaced a determined distance apart from each other, the heat dissipation portion of each heat dissipation unit is arranged concentrically around the axis with an equal radius so that the heat dissipation units each have a ring shape, the heat dissipation units are arranged in a multilayer configuration, the heat dissipation portion has an inner surface facing the axis and an outer surface facing away from the axis, the inner surface and the outer surface of the heat dissipation portion are curved surfaces;

wherein the heat dissipation units are classified into a first group and a second group, the heat dissipation units of the first group each have a single said heat dissipation fin, the heat dissipation portion of the heat dissipation fin of each heat dissipation unit of the first group is annular, the inner surface and the outer surface of the heat dissipation portion of each heat dissipation unit of the first group are annular surfaces, the heat dissipation units of the second group each have at least two said heat dissipation fins, the heat dissipation portions of the heat dissipation fins of each heat dissipation unit of the second group each have an arc shape, the inner surface and the outer surface of each heat dissipation portion of each heat dissipation unit of the second group are curved surfaces, an arc length of each of the inner surface and the outer surface of each heat dissipation portion of the second group is greater than a thickness of each heat dissipation portion of the second group, the heat dissipation portions of the heat dissipation fins of each heat dissipation unit of the second group are arranged concentrically around the axis with the equal radius, and the heat dissipation units of the second group each have the ring shape;

wherein, when in use, thermal energy of the lamp is transferred to the heat dissipation fins of the heat dissipation units of the heat dissipation body to be dissipated through air flow generated by the ceiling fan.

2. The lamp assembly as claimed in claim 1, wherein the connecting seat is formed with a plurality of through positioning holes each having a guide hole extending from its one side along a rotation direction, an inner wall of a long side of the guide hole is transversely provided with a protrusion, the connecting seat further includes a plurality of fasteners, one end of each fastener is fixedly connected to at least one of the heat dissipation module and the lamp, another end of each fastener has a head portion corresponding in position and diameter to a respective one of the positioning holes, each fastener further has a body portion extending from the head portion and corresponding in position and diameter to the guide hole, the head portion has a diameter greater than that of the body portion, the head portions of the fasteners are inserted in the positioning holes, the body portions of the fasteners enter the guide holes by pushing the protrusions, and the body portions of the fasteners are locked in the guide holes of the connecting seat through the protrusions, respectively.

3. The lamp assembly as claimed in claim 2, wherein the connecting seat further has elastic portions each corresponding to the protrusion, and the protrusion is arranged on a wall of a respective one of the elastic portions.

4. The lamp assembly as claimed in claim 1, wherein respective heights of the heat dissipation fins of the heat dissipation units gradually decrease from inside to outside.

5. The lamp assembly as claimed in claim 1, wherein the heat dissipation fins of the heat dissipation units are spaced apart from the connecting seat.

6. The lamp assembly as claimed in claim 1, wherein the heat dissipation portions of the heat dissipation fins of the heat dissipation units are connected by at least one connecting portion.

7. The lamp assembly as claimed in claim 1, wherein the connecting seat is formed with a plurality of through positioning holes each having a guide hole extending from its one side along a rotation direction, an inner wall of a long side of the guide hole is transversely provided with a protrusion, the connecting seat further includes a plurality of fasteners, one end of each fastener is fixedly connected to at least one of the heat dissipation module and the lamp, another end of each fastener has a head portion corresponding in position and diameter to a respective one of the positioning holes, each fastener further has a body portion extending from the head portion and corresponding in position and diameter to the guide hole, the head portion has a diameter greater than that of the body portion, the head portions of the fasteners are inserted in the positioning holes, the body portions of the fasteners enter the guide holes by pushing the protrusions, the body portions of the fasteners are locked in the guide holes of the connecting seat through the protrusions, respectively, the connecting seat further has elastic portions each corresponding to the protrusion, and the protrusion is arranged on a wall of a respective one of the elastic portions.

8. The lamp assembly as claimed in claim 1, wherein the ceiling fan includes a plurality of blades, and the heat dissipation module is located close to inner sides of the blades of the ceiling fan.

* * * * *